US005502863A

United States Patent [19]

Perkins

[11] Patent Number: 5,502,863

[45] Date of Patent: Apr. 2, 1996

[54] FINGER MOUNTED TOOTH BRUSH MANUFACTURED FROM LOOFAH

[76] Inventor: Timothy Perkins, 100-15B Donizetti Pl., Bronx, N.Y. 10475

[21] Appl. No.: 348,456

[22] Filed: Dec. 2, 1994

[51] Int. Cl.[6] ..... A47K 7/02; A47L 13/12

[52] U.S. Cl. ..... 15/227; 15/118; 15/167.1; 15/210.1; 401/7

[58] Field of Search ..... 15/118, 167.1, 15/210.1, 227, 244.1; 401/7

[56] References Cited

U.S. PATENT DOCUMENTS

| | | | |
|---|---|---|---|
| 405,806 | 6/1889 | Snyder | 15/227 |
| 1,144,777 | 6/1915 | Over | 401/7 |
| 1,470,710 | 10/1923 | Davis | 15/210.1 |
| 1,488,332 | 3/1924 | Foerg | 15/227 |
| 1,968,696 | 7/1934 | Mar | 15/227 |
| 2,016,951 | 10/1935 | Welker | 401/7 |
| 2,030,911 | 2/1936 | Borden | 401/7 |
| 2,068,162 | 1/1937 | Borchers | 15/227 |
| 2,318,365 | 3/1943 | Boysen | 15/227 |
| 3,694,845 | 10/1972 | Engelsher | 401/7 |
| 3,720,975 | 3/1973 | Nelson . | |
| 3,934,299 | 1/1976 | Regester | 15/227 |
| 5,026,541 | 6/1991 | Lanier | 15/227 |
| 5,107,562 | 4/1992 | Dunn . | |
| 5,213,428 | 3/1993 | Salman . | |
| 5,228,433 | 7/1993 | Rosen . | |
| 5,287,584 | 2/1994 | Skinner . | |
| 5,320,531 | 6/1994 | Delizo-Madamba . | |
| 5,348,153 | 9/1994 | Cole . | |

FOREIGN PATENT DOCUMENTS

| | | | |
|---|---|---|---|
| 608640 | 7/1926 | France | 401/7 |
| 2530940 | 2/1984 | France | 15/227 |
| 9784 | 5/1892 | United Kingdom | 15/227 |
| 2625 | 2/1911 | United Kingdom | 15/227 |
| 0025668 | 3/1913 | United Kingdom | 15/210.1 |
| 251415 | 5/1926 | United Kingdom | 401/7 |

OTHER PUBLICATIONS

Packaged Loofah Sponge, Distributed by "L Esprit", Division of Benny Marketing Systems, Inc., Port Washington, NY, 1991.

*Primary Examiner*—David Scherbel
*Assistant Examiner*—Randall E. Chin
*Attorney, Agent, or Firm*—Plevy & Associates

[57] ABSTRACT

A toothbrushing device comprising a sleeve of fibrous plant material, wherein the plant material comprises loofah. A portion of the sleeve defines a substantially coarse abrasive surface and another portion of the sleeve defines a substantially fine abrasive surface. The present invention is adapted to be mounted on a finger or on a wooden handle. Since the present invention is made from loofah, it can be disposed of without any substantial negative environmental effects.

12 Claims, 3 Drawing Sheets

FINGER MOUNTED TOOTH BRUSH MANUFACTURED FROM LOOFAH

FIELD OF THE INVENTION

This invention relates to a novel toothbrush and more particularly to a toothbrush manufactured from Loofah which can be fitted on a finger of a user for tooth cleaning, gum massaging and the like.

BACKGROUND OF THE INVENTION

Proper oral hygiene involves the personal care of one's teeth. This is accomplished by brushing the teeth regularly on a daily basis, usually after every meal and after snacks. Toothbrushing is typically performed using a conventional well known toothbrush device having a head with bristles adjoining a rigid handle. The toothbrush is grasped by the handle with the user's hand as the user brushes the teeth with the bristles in the head portion of the toothbrush device.

The toothbrushing device described above have a number of disadvantages. For example, conventional toothbrushes ordinarily can not be maintained in the sanitary condition because ordinary washing does not destroy the common bacteria that attaches to the bristles during brushing. Moreover, the not-so-portable design of such toothbrushing devices makes it difficult to adhere to a proper routine of oral hygiene, especially when the user happens to be situated where no bathroom facilities are available for toothbrushing. Since conventional toothbrushes were designed to be used and stored in a bathroom facility, they do not lend themselves to being carried in a pocket or purse. In particular, toothbrushes are awkward to carry and store because they are to long for concealment in clothing pockets and are easily contaminated by the environment. Further, since toothbrushes are relatively expensive to purchase on a daily basis, it is impractical to discard them after only a single use.

Conventional toothbrushes have other problems which are inherent in their design. Since the bristle portion of the toothbrush sits at one end of a 7 or 8 inch handle, brushing requires a certain amount of dexterity. Younger children typically lack such dexterity as do people who have suffered a stroke or other disabling illness or disease.

In such situations, it would be more convenient to have the brush mounted on the finger. This is especially true for instance, if the person is attempting to brush the teeth of a child or the teeth of an animal, such as a dog. Further, fingermounted toothbrushing devices offer the user a better feel of the toothbrush and thus, a better idea of the quality of the brushing job being performed. Generally speaking, much greater control and flexibility can be achieved when the brush is manipulated by a finger.

Many attempts have been made in the prior art, to design a brush structure which is to be fixed or held upon the finger of the user. In U.S. Pat. No. 3,720,975 entitled TOOTHBRUSHES and issued to Nelson on Mar. 20, 1973, a toothbrush adapted for finger manipulation is described. This finger toothbrush device includes a finger manipulated member with an array of bristles arranged in a formation along an axis extending forwardly from the member. According to this patent, the toothbrush described therein has been adapted to be especially useful in cleaning the cervical areas of the teeth.

A finger-held toothbrush including an inner portion which is wholly received within an outer portion when the toothbrush is in the stored condition is disclosed in U.S. Pat. No. 5,107,562 entitled DISPOSABLE FINGER MOUNTED TOOTHBRUSH WITH HOLDING MEANS issued to Dunn on Apr. 28, 1992. The outer portion of this device includes an upper flap and lower flap that are releasable secured to one another about their respective peripheral borders. When the top flap is peeled back, the bottom flap separates from the top flap and the inner portion of the toothbrush mounting the bristles of the brush become exposed.

A disposable toothbrush made out of a biodegradable material, such as biodegradable plastic, is disclosed in U.S. Pat. No. 5,213,428 entitled BIODEGRADABLE TOOTHBRUSH issued to Salmon on May 25, 1993. This toothbrush includes cap with a flattened portion which define two or four rows of short bristles. The bristles are impregnated with a dehydrated toothpaste which bond to the bristles to form a defined layer on top of the bristles. When these bristles contact water, the impregnated toothpaste aids in the brushing of the teeth. Upon completion, the entire toothbrush is disposed of.

A tooth and gum brush that includes a flexible sheet or pad that can carry a cleaner, a mild abrasive, medicants or other substances is described in U.S. Pat. No. 5,228,433 entitled FINGER MOUNTED DENTAL APPLIANCE issued to Rosen on Jul. 20, 1993. This toothbrush device includes a miniature hook and loop fastener arrangement for fastening the appliance about a user's finger. The pad can be formed of a cotton loop woven cloth and the tab can be a separate strap or integral portion of the pad.

A finger toothbrushing device for use on human beings and animals is shown in U.S. Pat. No. 5,287,584 entitled TOOTHBRUSH issued to Skinner on Feb. 22, 1994. This patent discloses a device comprising a base portion with the plurality of bristles secured in and protruding from a base portion. Friction enhancing ribs are formed on the interior surfaces of the device.

In U.S. Pat. No. 5,320,531 entitled ABSORBENT FINGER SLEEVE FOR USE IN DENTISTRY OR MEDICINE issued to Belizo Madanba on Jun. 14, 1994 there is shown an absorbent sleeve which is formed over a portion of a finger. This device is not designed to brush teeth but instead to absorb fluids and remove debris from areas that are constrained in a body such as canals and cavities or used to apply fluid substances.

Finally, in U.S. Pat. No. 5,848,153 entitled DISPOSABLE INDIVIDUAL GELLED INSTANT TOOTHBRUSH issued to Cole on Sep. 20, 1994, there is disclosed a disposable teeth cleaning kit which includes a finger mounted toothbrush having a substantially cylindrical elastic sheath with a closed end and an open end. The brush portion is disposed on this sheath adjacent its closed end.

One feature that is common to essentially all these prior art finger-mounted toothbrush devices is that they are manufactured from synthetic materials which tend to have undesirable environmental disposal aspects. Such a disadvantage is quite significant in devices that are intended to be used only once and then discarded, such as these.

Thus, there exists a need for a finger-mounted toothbrush that can be discarded without negatively impacting the environment.

It is, therefore, a primary object of the present invention to provide an improved finger-mounted toothbrush that can be discarded without any significant negative impact on the environment.

SUMMARY OF THE INVENTION

A toothbrushing device comprising a sleeve of fibrous plant material, the material comprising loofah. A portion of the sleeve defines a substantially coarse abrasive surface and another portion of the sleeve defines a substantially fine abrasive surface.

It is preferred that the present invention be adapted to be mounted on a finger, however it may also be adapted for mounting on a wooden handle. Since the toothbrush according to the present invention is made from loofah, it can be disposed of without any substantial negative environmental effects.

BRIEF DESCRIPTION OF THE DRAWINGS

The present invention will be better understood upon the reading the foregoing Detailed Description in conjunction with the drawings wherein.

DETAILED DESCRIPTION OF THE INVENTION

Figure 1A:
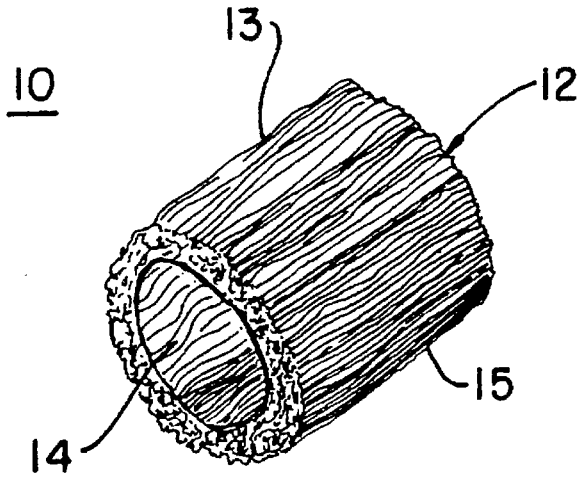
FIG. 1A is a perspective view of a preferred exemplary embodiment of the toothbrush device of the present invention.
Figure 1B:
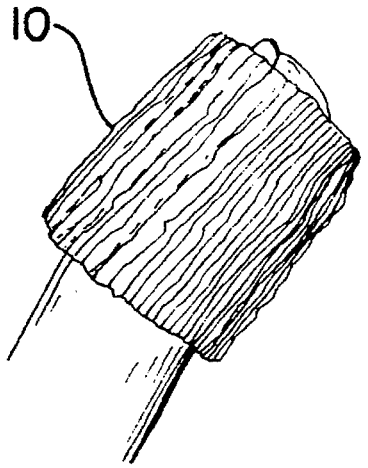
FIG. 1B is a perspective view showing the toothbrush of the present invention mounted on a finger.

In FIG. 1A is there is shown a preferred exemplary embodiment of the finger mounted toothbrush of the present invention designated by the numeral 10. As can be seen, the finger toothbrush 10 is configured as a sleeve 12 of fibrous material defining an opening 14 which is adapted for slidably receiving a finger of a human hand as shown in FIG. 1B. The fibrous structure of the toothbrush 10 is provided by fabricating it from a plant called loofah.

Loofah is a gourd type vegetable of the squash family. Loofah is naturally grown in the Orient. The interior portion of dried loofah is fibrous and resembles steel wool. People who are familiar with loofah commonly refer to the interior portion of dried loofah as vegetable sponge. This fibrous sponge-like structure has unique abrasive characteristics.

Dried loofah has found use in a variety of applications where its unique abrasive characteristics have been put to good use. One such application has been in the skin care industry as a skin care product for removing dead skin cells. More particularly, the skin care industry drys and processes loofah into washing sponges. The unique abrasive characteristics of the dried and processed loofah, enables it to be used as a natural sponge-like skin conditioner. As such, the techniques used for drying and processing loofah are well known in the art.

The loofah used in the present invention has the appropriate amount of abrasiveness for brushing or polishing of the teeth, massaging of the gums and the like. Further, the abrasive qualities of the loofah used in the present invention can be altered by varying the density of the loofah. When the fibers of the loofah are processed to form a relatively loose packing, the toothbrush 10 provides a coarse brush-like quality. When the fibers of the loofah are processed to form a more dense packaging relative to the packing described above, the toothbrush 10 provides a fine polisher-like quality.

In the preferred embodiment of FIG. 1A, approximately half of the sleeve 12 is fabricated from loosely packed loofah at 13 and the remaining half at 15, is fabricated from more densely packed loofah. This provides the toothbrush 10 with a variable abrasive quality. Accordingly, half of the sleeve member is fabricated from the loosely packed loofah which can be used for general brushing of the teeth, while the more densely packed half can be used for polishing of the teeth or gum massage. In the alternative, the entire toothbrush 10 can be fabricated from loosely packed loofah for general brushing.

Figure 2:
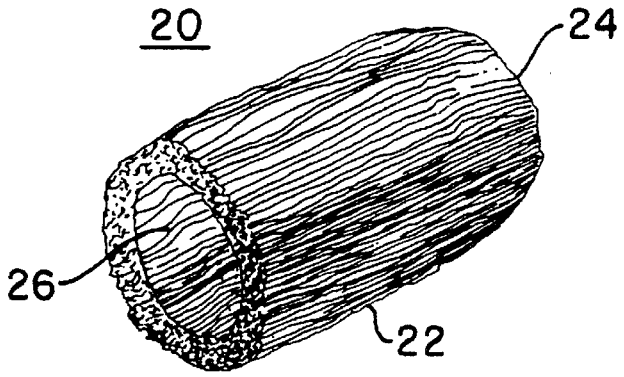
FIG. 2 is a perspective view of a second exemplary embodiment of the present invention.

In FIG. 2, a second exemplary embodiment of the toothbrush device of present invention is shown and is designated by the numeral 20. According to this embodiment of the invention, the toothbrush 20 comprises a sleeve 22 of loofah that is closed at one end with a unitarily formed cap portion 24. The other end of the toothbrush 20 defines an opening 26 which is adapted to slidably receive a finger of a human hand. As in the embodiment of FIG. 1, it is preferred that approximately half of the sleeve 22 be fabricated from loosely packed loofah and the remaining half be fabricated from more densely packed loofah. Alternatively, the entire toothbrush 20 can be fabricated from loosely packed loofah for general brushing.

Fabricating the present invention substantially from loofah allows the toothbrush of the present invention to be easily discarded without creating any undesirable environmental problems. This is because loofah is all natural and thus, substantially biodegradable. Moreover, although the present invention is intended to be disposed after a single use, it can be reused like a conventional toothbrush if desired.

Figure 3A:
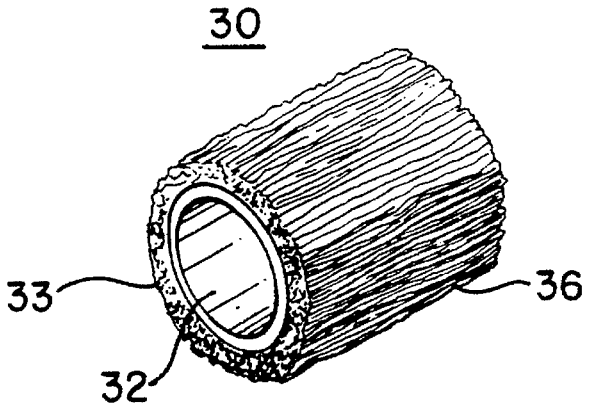
FIG. 3A is a perspective view of a third exemplary embodiment of the present invention.
Figure 3B:
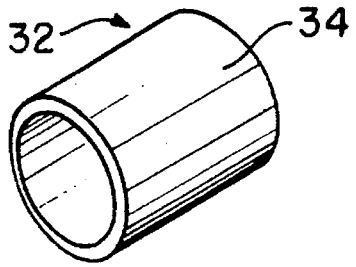
FIG. 3B is a perspective view of the collar shown in FIG. 3A.

FIGS. 3A and 3B show a third exemplary embodiment of the present invention designated by the numeral 30 which has been designed for applications where it may not be desirable to have direct contact between the finger and the toothbrush. The toothbrush 30 comprises a collar 32 defining a finger receiving opening 33, made of plastic or any other suitable material. A sleeve 36 of loofah is bonded to the outer surface 34 of the collar 32 with some type of adhesive or the like. The collar 32 helps to prevent the transfer of bacteria between the finger and the mouth, since without the collar, saliva can penetrate the loofah and make contact with the user's finger. Thus, providing a collar would be desirable in applications where the toothbrush is used to brush another person's teeth or in applications involving the brushing of an animal's teeth such as a dog or cat. In such applications the collar would also provide a degree of protection for the finger, should the user get bitten by the other person or animal whose teeth the user is brushing.

Figure 4A:
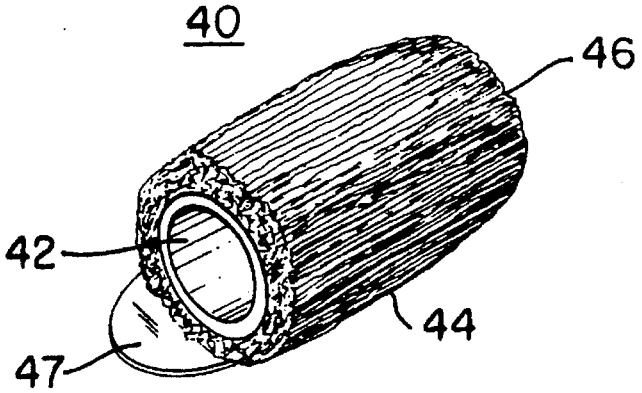
FIG. 4A is a perspective view of a fourth exemplary embodiment of the present invention.
Figure 4B:
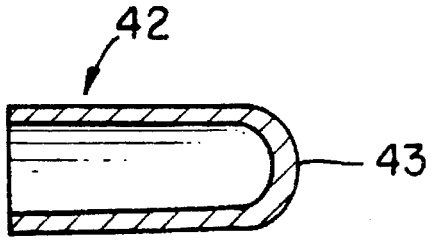
FIG. 4B is a cross-sectional view of the collar show in FIG. 4A.

A variation of the embodiment of FIG. 3A and 3B is shown in FIGS. 4A and 4B is designated by the numeral 40. This embodiment is very similar to the embodiment shown in FIG. 3A and 3B, however, the collar 42 is closed at one end with a unitarily formed cap 43 as shown in FIG. 4B. Further, the sleeve of loofah 44 is closed off by a unitarily formed cap 46 of loofah which is bonded over the outer surface of the collar 42.

In both of the embodiments of FIGS. 3A and 3B and FIGS. 4A and 4B, it is preferred that approximately half of the sleeve be fabricated from loosely packed loofah and the remaining half be fabricated from more densely packed loofah. Alternatively, the entire sleeve can be fabricated from loosely packed loofah for general brushing.

Figure 5:
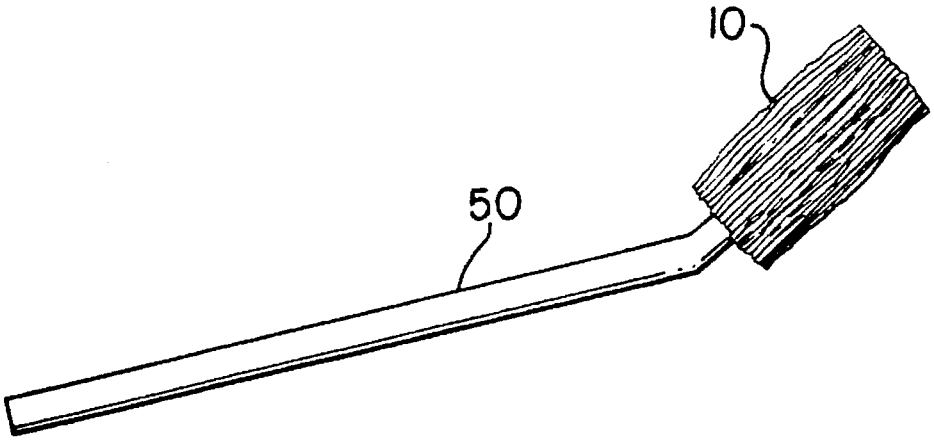
FIG. 5 illustrates the toothbrush of FIG. 1 mounted to a handle.

Although the present invention is intended to be worn on a finger, it is possible to mount the present invention on a handle as shown by example in FIG. 5. As can be seen, the toothbrush of FIG. 1 (or FIG. 2, not shown) can be mounted on a handle 50, preferably a wooden stick, and used conventionally like a traditional toothbrush. Such an arrangement maintains the positive environmental effect of the loofah. Further, in any of the above-described embodiments, a layer of dehydrated toothpaste can be provided on the sleeve if desired for a single use.

It should be understood that the embodiments described herein are merely exemplary and that a person skilled in the art may make many variations and modifications to these embodiments utilizing functionally equivalent elements to those described herein. For example, in the above-described embodiments, it is possible to provide a pull tab 47 on either end or both ends of the toothbrush as shown in FIG. 4A. Preferably, the pull tab or tabs would be unitarily formed out of the loofah, however the pull tab or tabs could be made from any other desirable material that is substantially biodegradable.

In any case, these and all other variations or modifications as well as others which may become apparent to those skilled in the art, are intended to be included within the scope of the invention as defined by the appended claims.

I/we claim:

1. A toothbrushing device comprising a sleeve of fibrous plant material, wherein a first portion of said sleeve defines a substantially coarse abrasive surface and a second portion of said sleeve defines a substantially fine abrasive surface, said device further comprising a cap at an end of said sleeve made from said plant material.

2. The toothbrushing device according to claim 1, wherein said cap and said sleeve are unitarily formed.

3. The toothbrushing device according to claim 1, further comprising a collar having an outer surface, said sleeve of plant material being attached to said outer surface of said collar.

4. The toothbrushing device according to claim 3, further comprising a cap unitarily formed with said collar and a cap of said plant material bonded to said unitarily formed cap of said collar.

5. The toothbrushing device according to claim 1, wherein said device is adapted to be mounted on a finger.

6. The toothbrushing device according to claim 1, wherein said device is adapted to be mounted on handle extension means.

7. A brushing device for mounting on a finger, comprising a sleeve of loofah having two degrees of abrasiveness, one of said two degrees being of a substantially coarse degree of abrasiveness and the other of said two degrees being of a substantially fine degree of abrasiveness, said device further comprising tab means attached to said sleeve to facilitate application and removal of said sleeve from the finger.

8. The brushing device according to claim 7, further comprising a layer of dehydrated toothpaste embedded on said sleeve.

9. The brushing device according to claim 7, further comprising a cap of loofah attached to an end of said sleeve.

10. The brushing device according to claim 9, wherein said cap and said sleeve are unitarily formed, said cap being operative to cover the tip of the finger.

11. A disposable toothbrushing device for mounting on a finger, comprising a sleeve of loofah having a first substantially coarse abrasive surface and a second substantially fine abrasive surface wherein said sleeve is terminated by a cap of unitarily formed loofah.

12. The disposable toothbrushing device according to claim 11, wherein said sleeve includes tab means attached to said sleeve to facilitate application and removal of said sleeve from the finger.

* * * * *